US005404621A

United States Patent [19]

Heinke

[11] Patent Number: 5,404,621

[45] Date of Patent: Apr. 11, 1995

[54] CLOSURE FOR PLASTIC BAGS

[76] Inventor: Richard M. Heinke, P.O. Box 81206, Lincoln, Nebr. 68501

[21] Appl. No.: 209,433

[22] Filed: Mar. 10, 1994

[51] Int. Cl.[6] ..... B65D 77/10

[52] U.S. Cl. ..... 24/30.5 R; 383/71

[58] Field of Search ..... 383/70, 71; 24/30.55, 24/30.5 R, 3 B, 30.5 P

[56] References Cited

U.S. PATENT DOCUMENTS

| | | | |
|---|---|---|---|
| 1,242,139 | 10/1917 | Callahan | 383/71 X |
| 3,997,943 | 12/1976 | Jones et al. . | |
| 4,306,745 | 12/1981 | Wenk . | |
| 4,357,740 | 11/1982 | Brown | 24/30.5 S |
| 4,501,049 | 2/1985 | Adamson | 24/30.5 P |
| 4,514,876 | 5/1985 | Houlberg . | |
| 4,537,432 | 8/1985 | Meeks | 24/30.5 P X |
| 4,697,312 | 10/1987 | Freyer | 24/30.5 S |
| 4,835,820 | 6/1989 | Robbins, III . | |
| 4,871,642 | 10/1989 | Tamagawa et al. . | |
| 4,887,335 | 12/1989 | Folkmar . | |
| 4,951,362 | 8/1990 | Denemark et al. . | |
| 5,109,576 | 5/1992 | Teekell et al. . | |
| 5,199,794 | 4/1993 | Lipes . | |

*Primary Examiner*—Allan N. Shoap
*Assistant Examiner*—Jes F. Pascua
*Attorney, Agent, or Firm*—Zarley, McKee, Thomte, Voorhees & Sease; Dennis L. Thomte

[57] ABSTRACT

A closure for closing plastic bags comprising a truncated, hollow cone having an opening extending therethrough for receiving the bunched neck of a plastic bag or the like. The cone is provided with a plurality of spaced-apart gripping fingers which engage the bunched neck of the plastic bag to prevent the cone from becoming detached from the bag. An optional weak section is provided in the closure to enable the closure to be selectively opened to remove the closure from the bag.

1 Claim, 2 Drawing Sheets

CLOSURE FOR PLASTIC BAGS

BACKGROUND OF THE INVENTION

1. Field of the Invention

This invention relates to a closure device and more particularly to a closure for closing plastic bags or the like.

2. Description of the Related Art

Many types of closures have been provided for closing the bunched end of a plastic bag or the like. Perhaps the most common type of closure is the twist tie type which consists of a thin wire embedded in an elongated strip of plastic or paper. While the twist ties are generally satisfactory and are fairly easy to use, the twist ties are easily dislodged from the bag and therefore do not provide a secure closure.

Another type of common closure is the "saw blade" type which is comprised of an elongated flat plastic member having an opening at one end thereof and a plurality of serrated teeth at the other end thereof which are adapted to be received in the opening at the other end of the device. These type of closures are more difficult to use and are not believed to provide a positive closure for the bag.

Other types of bag closures are described in U.S. Pat. Nos. 3,997,943; 4,306,745; 4,835,820; 4,871,265; 4,887,835; 4,951,362; 5,109,576 and 5,199,794. All of the prior art closure devices are believed to suffer one or more shortcomings whether those shortcomings be convenience of use, durability, positive lock, expense, etc.

BRIEF DESCRIPTION OF THE DRAWINGS

FIG. 5 is a sectional view of the closure mounted on a plastic bag or the like.

SUMMARY OF THE INVENTION

Figure 1:
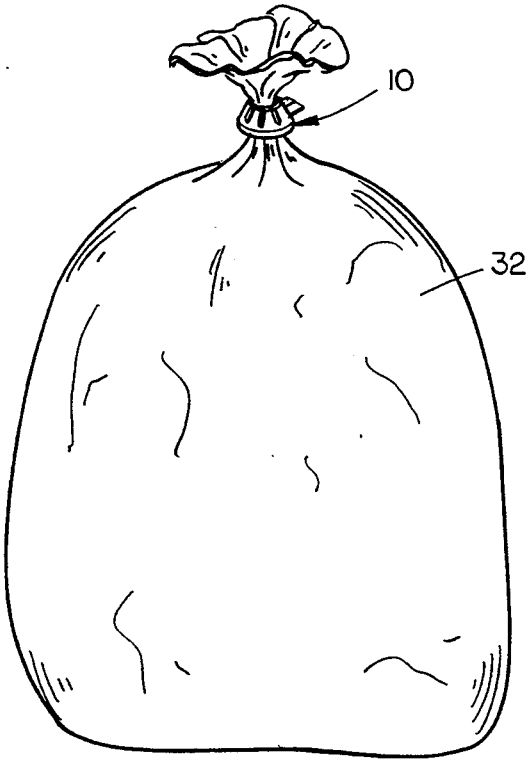
FIG. 1 is a perspective view of a plastic bag or the like having the closure of this invention mounted thereon.

A closure is described for closing the gathered or bunched end or neck of a plastic bag or the like. The closure comprises a hollow truncated cone having lower and upper ends. The truncated cone is provided with an upstanding wall portion at its lower end and a plurality of spaced-apart gripping fingers extending upwardly and inwardly from the upper end of the upstanding wall portion. The upper ends of the gripping fingers define an opening at the upper end of the cone while the lower end of the upstanding wall portion defines an opening through which the upper end of the bunched end of the bag is inserted. The bunched end or neck of the bag is pulled through the interior of the cone until the desired amount of bag projects upwardly from the cone. The cone positively closes the bag and the gripping fingers "dig into" or engage the exterior surface of the bunched neck of the bag to prevent the cone from inadvertently becoming dislodged from the bag. The cone is comprised of an olafinic plastic which has been injection molded so that the closure is flexible. The flexible nature of the cone permits the gripping fingers to deflect outwardly from the bag as the bunched neck of the bag is being pulled through the cone.

In the preferred embodiment, the closure is provided with a pair of tabs which extend from the closure and which are joined by a weak tear line or section which communicates with a weak line or tear section which extends into the truncated cone. The weak lines permit the closure to be removed from the bag if desired. The closure may then be re-used if necessary.

It is therefore a principal object of the invention to provide an improved closure for a plastic bag of the like.

A further object of the invention is to provide an improved closure for a plastic bag or the like which is comprised of a truncated conical-shaped member having a plurality of spaced-apart gripping fingers.

A further object of the invention is to provide a closure for a plastic bag or the like which is easy to use and provides a positive closure of the bag.

Yet another object of the invention is to provide a bag closure which includes a weak tear line to enable the closure to be opened for removal from the bag.

Still another object of the invention is to provide a bag closure for a plastic bag or the like which is economical of manufacture and easy to use.

These and other objects of the invention will be apparent to those skilled in the art.

DESCRIPTION OF THE PREFERRED EMBODIMENT

The numeral 10 refers to the closure of this invention which is preferably comprised of an injection molded olafinic plastic material. Closure 10 is in the form of a truncated, hollow cone having a first large lower end 12 defining central opening 13 and a second small upper end 14. For purposes of description, closure 10 will be described as having an inside surface 16 and an outside surface 18.

Figure 2:
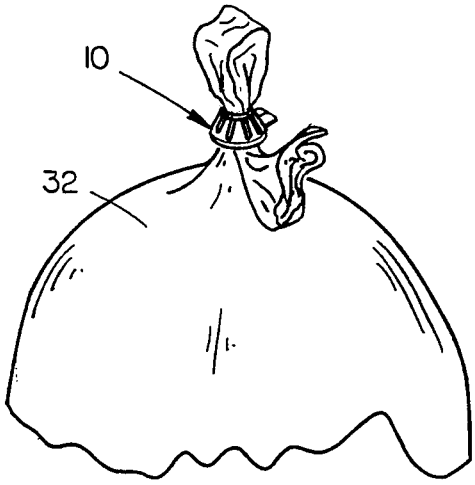
FIG. 2 is a view similar to FIG. 1 except that the bunched neck of the plastic bag or the like has been folded upon itself prior to insertion into the closure.
Figure 3:
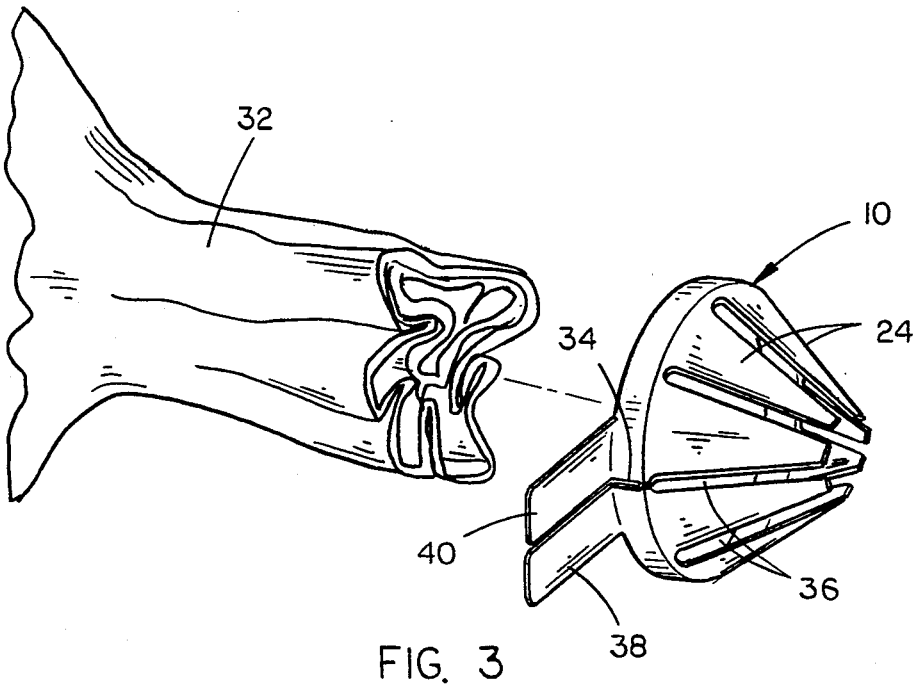
FIG. 3 is a perspective view illustrating the relationship between the closure of this invention and the bunched neck of a plastic bag.
Figure 5:
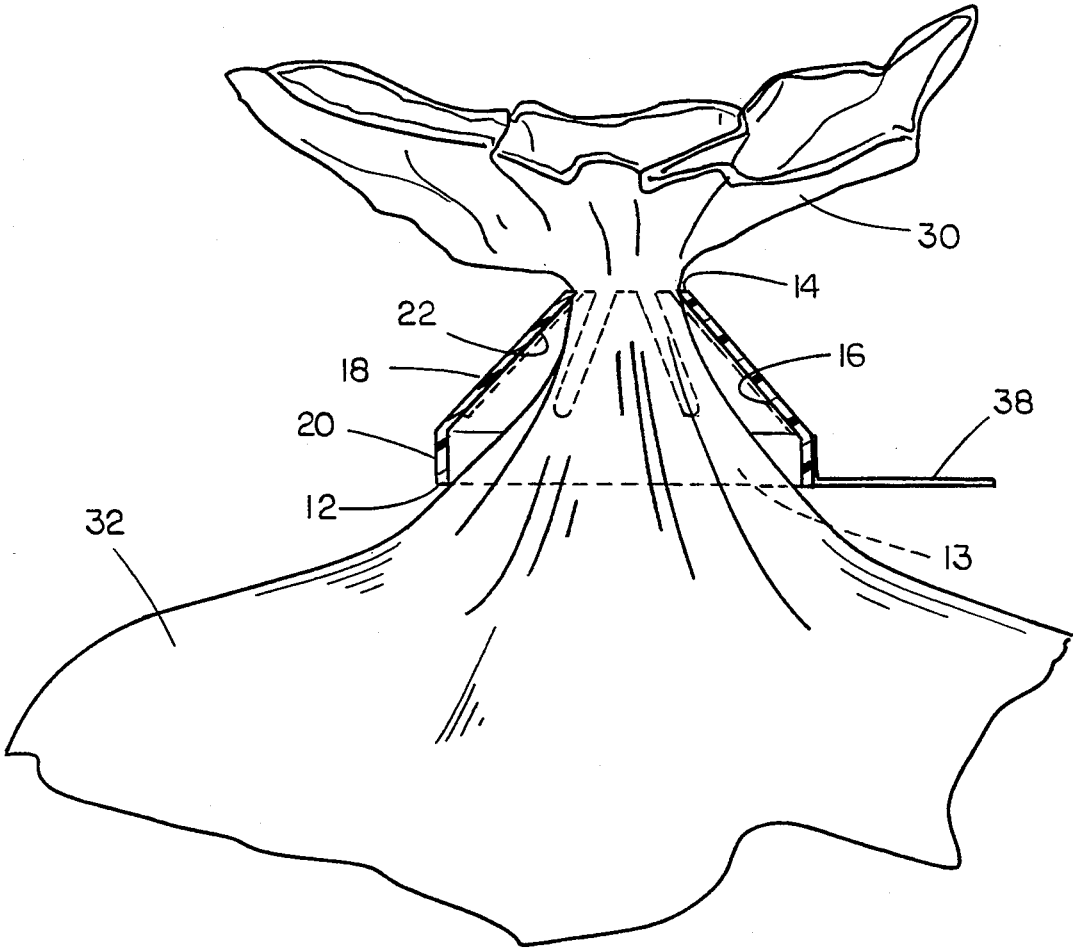

Closure 10 preferably includes an upstanding wall portion 20 having an inclined wall portion 22 extending upwardly away from end 12 and inwardly towards upper end 14. Inclined wall portion 20 is provided with a plurality of flexible, gripping fingers 24 having upper ends 26. As seen in the drawings, the upper ends 26 of fingers 24 define an opening 28 therebetween through which the bunched neck 30 of a plastic bag 32 may be inserted as illustrated in FIGS. 1 and 5. If desired, the bunched neck 30 of the bag 32 may be folded upon itself as illustrated in FIG. 2 and inserted through the closure 10 as will be described hereinafter.

Figure 4:
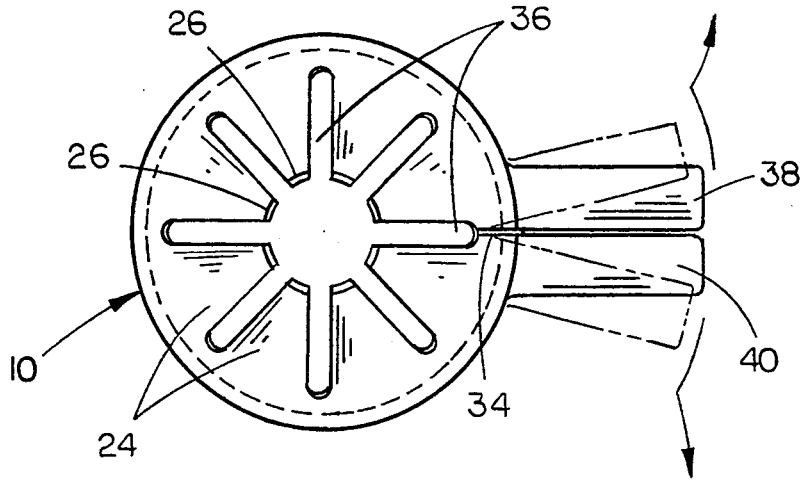
FIG. 4 is a top elevational view of the closure of this invention.

Closure 10 is provided with an optimal section (tear line) 34 which extends from the lower end of one of the slits 36 to the lower end 12. Optimal tabs 38 and 40 extend laterally from the lower end 12 as seen in FIG. 4. If it is desired to remove the closure 10 from the bag 32, the tabs 38 and 40 are gripped and spread apart to rupture the weak section 34 thereby permitting the closure 10 to be opened and released from the bag.

The diameter of the opening 13 and the diameter of the opening 28 is dependent upon the size of the plastic bag being closed. For example, for plastic bags having a capacity of 24–31 gallons, the diameter of opening 13 is preferably 1 1/16 inches and the diameter of opening 28 is preferably 5/16 inch.

In use, the bunched or gathered neck 30 of the bag 32 is inserted upwardly into opening 13 and is pulled through the interior of the closure 10 until the closure 10 is properly located with respect to the neck 30 of the bag 32 which will normally be dependent upon the amount of material enclosed within the bag. As the neck 30 is pushed through the opening 28, the gripping fingers 24 deflect outwardly to permit the neck 30 to be easily pulled through the closure 10. When the neck 30 has been sufficiently pulled through the closure 10, the upper ends 26 of the gripping fingers 24 grip or engage the neck 30. The gripping action of the fingers 24 into the neck 30 prevents the closure from being inadvertently removed from the bag 32.

If additional positive closure is required, it is recommended that the bunched neck 30 be folded upon itself as illustrated in FIG. 2 with the folded or "doubled" portion of the neck 30 being inserted through the closure.

If it is desired to reuse the closure 10, the remaining thickness of the wall portion 20 will have sufficient circumferential memory to allow the closure to be reused as a supplementary bag closure device such as bread bags, food bags, etc. In such a case, it will be evident to a user that the closure has been ruptured and possibly removed from the bag.

An important feature of the thin tear section 34 (also the material flow weld line) is the extra tamper evident nature provided to assure the first owner or user that the contents of the bag have not been previously breached due to the semi-delicate nature of the tear section in that any activity intended to remove the closure would likely cause either tearing of the bag or tearing of the weak section providing certain obvious evidence of likely intrusion or an intent to intrude.

Thus it can be seen that a novel bag closure has been provided which is easy to position on a plastic bag or the like to provide a positive seal or closure for the bag. It can also be seen that a closure has been provided which includes flexible gripping fingers which engage or "dig into" the bag to prevent the closure from becoming dislodged from the bag. It therefore can be seen that the invention accomplishes at least all of its stated objectives.

I claim:

1. A closure for closing plastic bags, comprising, a truncated, hollow cone having an opening extending therethrough for receiving the bunched neck of a plastic bag;

said cone having a plurality of gripping fingers provided thereon for engagement with the bunched neck of the plastic bag for preventing the cone from becoming detached from the bag;

said cone having an upstanding side wall portion at its lower end and wherein said gripping fingers extend upwardly and inwardly from said upstanding side wall portion; said side wall portion having a weak section formed therein which may be ruptured to permit the closure to be opened and removed from the bag;

and a pair of tabs extending from said side wall portion adjacent said weak section to facilitate the selective rupturing of said weak section.

* * * * *